US005639251A

United States Patent [19]

Harting et al.

[11] Patent Number: 5,639,251

[45] Date of Patent: Jun. 17, 1997

[54] ELECTRICAL CONNECTOR

[75] Inventors: Dietmar Harting, Espelkamp; Roger Moellers, Nottuln; Guenter Pape, Bielefeld, all of Germany

[73] Assignee: Harting Elektronik GmbH, Espelkamp, Germany

[21] Appl. No.: 514,640

[22] Filed: Aug. 14, 1995

[30] Foreign Application Priority Data

Aug. 19, 1994 [DE] Germany ..... 44 29 432.8

[51] Int. Cl.[6] ..... H01R 9/09

[52] U.S. Cl. ..... 439/79; 439/108

[58] Field of Search ..... 439/108, 101, 439/79, 62, 80

[56] References Cited

U.S. PATENT DOCUMENTS 4,054,345 10/1977 Sherwood ..... 439/79
4,655,518 4/1987 Johnson et al. ..... 439/62
4,734,045 3/1988 Hawkins ..... 439/79
5,104,329 4/1992 Brown et al. ..... 439/108
5,199,884 4/1993 Kaufman et al. ..... 439/80
5,403,196 4/1995 Northey et al. ..... 439/108

*Primary Examiner*—Neil Abrams
*Assistant Examiner*—Brian J. Biggi
*Attorney, Agent, or Firm*—Jordan and Hamburg

[57] ABSTRACT

For an electrical plug-in connector, particularly a multi-pole knife-type connector having a collar surrounding the plug-in ends of the contact elements, further contact elements are incorporated into the sides of the collar, the contact elements being accessible from the outside of the collar for mating electrical contact with corresponding contacts of a mating plug.

15 Claims, 2 Drawing Sheets

ELECTRICAL CONNECTOR

BACKGROUND OF THE INVENTION

The invention relates to an electrical connector, and more particularly, a multi-pole knife-type plug-in connector of substantially rectangular form having a carrier body of insulating material. Contact elements or pins, disposed in rows and columns, are inserted in a bottom part of the body. The body includes a collar which surrounds the plug-in area and the contact elements.

Such connectors are used as circuit board plug-in connectors and are known from Standard IEC 603-2.

SUMMARY OF THE INVENTION

The invention aims at further developing this type of plug-in connector so that the number of contacts available is increased substantially without any substantial increase in the overall dimensions of the plug-in connector. It is intended also to ensure that existing standardized mating plugs can be fitted together with the plug-in connector.

The invention achieves its aim in that in addition to the inner rows of contacts there is provided a further row of contacts with contact ends in the region of the collar. Longer sides of the collar are provided with recesses in which the contact ends are housed so that lateral surfaces of the further contacts are accessible from outside the collar for mating contact with corresponding contact elements of a mating plug.

The advantages achieved thanks to the invention consists particularly in that the number of plug-in contacts available with the plug-in connector has been substantially increased without the external dimensions being increased. In this respect, it is particularly advantageous that a conventional standard mating plug can be fitted to the plug-in connector in specific applications where there may be no need for the increased number of contacts. A further advantage lies in a further development of the invention in that the contacts of the outer rows of contacts are rigidly held in the protective collar.

An embodiment of the invention will now be described by way of example with reference to the accompanying drawings.

DESCRIPTION OF THE PREFERRED EMBODIMENTS

Figure 1:
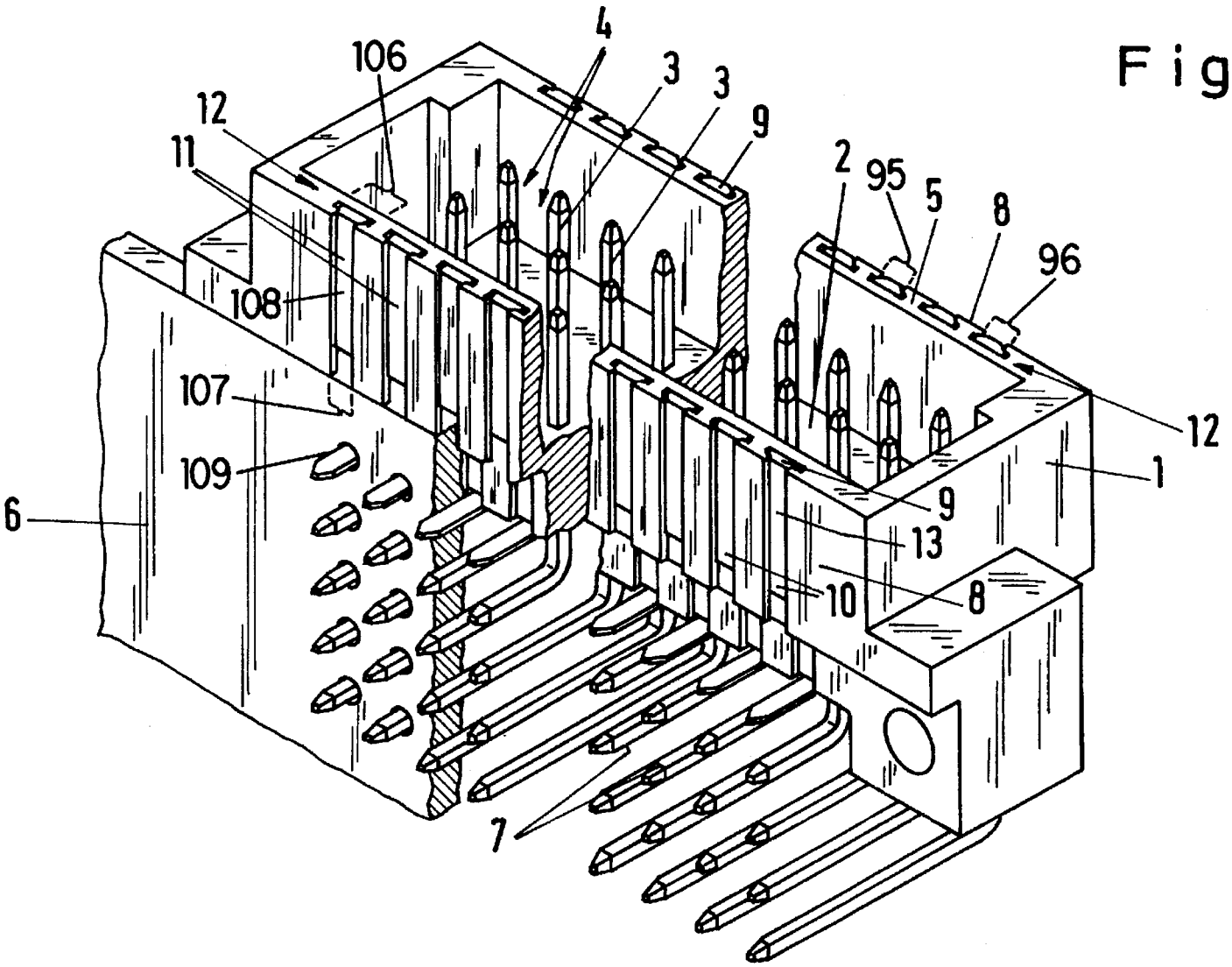
FIG. 1 is a perspective view of a plug-in connector according to the invention.
Figure 2:
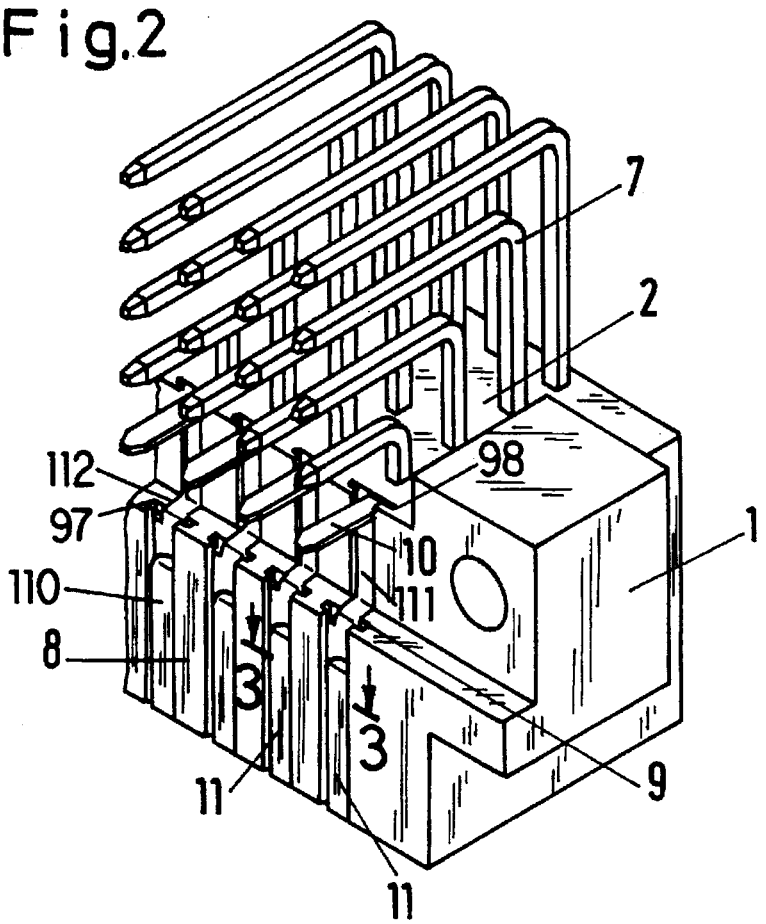
FIG. 2 is a partial perspective view of the under side of the plug-in connector according to FIG. 1.

The plug-in connector shown in FIGS. 1 and 2 consists essentially of a carrier body 1 of insulating material with a bottom part 2 in which there are pin-shaped contact elements 3. The contact elements are disposed in known manner in columns and rows and their plug-in side 4 is enclosed by a rectangular collar, sleeve or shroud 5. The plug-in connector is intended for use with a circuit board 6 and the connection ends 7 of the contact elements are turned through a right-angle and fit into corresponding holes in the circuit board.

The geometry of the collar and the disposition of the contact elements is such that a commercially available mating plug in accordance with Standard IEC 603-2 can be fitted together with the plug-in connector.

Integrally formed in the longitudinal sides 8 of the collar 5 are pocket-like recesses 9 which are open towards the outside of the collar. Pushed or inserted into these recesses are further contact elements 10, the lateral surfaces 11 of which are thereby accessible to being contacted by contact elements of a mating plug which is not shown here.

These further contact elements 10 form rows 12 of contacts which are disposed parallel with the contact zone enclosed by the collar 5.

The contact elements 10 inserted into the recesses 9 are provided at their contact end 13, i.e. at the end which is to be connected with the corresponding mating plug in a contact making fashion, with lateral side sections 14 which are angled-over or turned-down so that the contact ends are held and guided in the recesses. For fixing the contact elements, their lateral side sections 14 have integrally formed retaining means or barb-like elements 15 which, when the contact ends are pushed into the recesses 9, engage in recess side walls 16 and ensure a secure seating of the contact elements 10.

Figure 3:
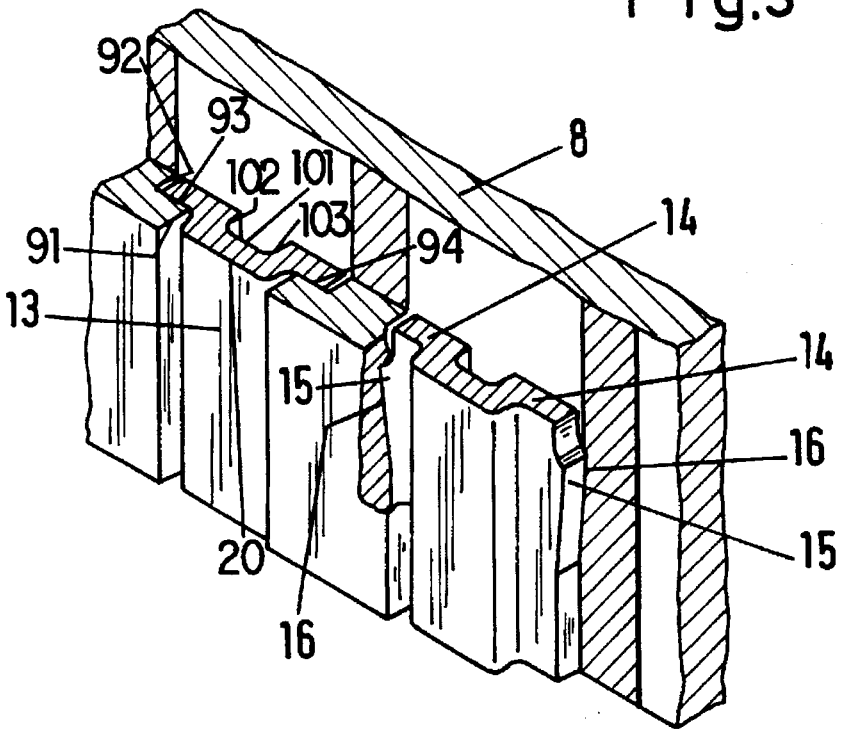
FIG. 3 is a view of the contact fixing in cross-section.

As shown in FIG. 3, the recess means includes an outer portion 91 and an inner portion 92 with the outer portion 91 forming an opening which opens up into the outer wall of the collar 5. The inner portion 92 has lateral side channels 93, 94 located on either side of the outer portion 91. The contact element 10 has two lateral side sections 14 on either side of a raised central section 20. Thus the contact element 10 has a generally U-shaped cross-sectional configuration having a base part 101 and two legs 102, 103 extending from the base part 101. The inner portion 92 of the recess 9 has a first width 95 and the outer portion 91 of the recess 9 has a second width 96 which is less than the first width 95. The two lateral side sections 14 of the contact member 10 are disposed in the inner recess portion 92 and the raised central section 20 is disposed in the outer recess portion 91. The two lateral side sections 14 have a total third width 106 and the raised central section 20 has a fourth width 107 which is less than the third width 106.

The contact members 10 have a first part 108 disposed in the recess 9 and a second part 109 extending from the body generally parallel to the extending pin sections as shown in FIG. 1.

As shown in the embodiment of FIG. 2, the recesses have a first portion 97 and a second portion 98. The first portion 97 is formed in a generally planar indented wall 8 which is parallel to and spaced from the collar 5. The contact element includes a first section 110 disposed in the first portion 97 of the recess and a second section 111 disposed in the second portion 98 of the recess. A third section 112 of the contact element joins the first and second sections 110 and 111 at right angles as shown in FIG. 2.

What we claim is:

1. An electrical multi-pole plug-in connector adapted to receive a mating plug having engageable parts, comprising a body means of insulating material, a plurality of contact pin elements disposed on said body means, said body means having a bottom part, said plurality of contact pin elements having extending pin portions extending from said bottom part, said body means having a collar extending from said bottom part, said collar defining a plug-in space with said collar surrounding said plug-in space, said extending pin portions extending into said plug-in space, said collar having an outer wall, recess means in said outer wall of said collar, and contact members disposed in said recess means, said extending pin portions and said contact members being engageable with said engageable parts of said mating plug, said recess means comprising an outer portion and an inner portion, said outer portion forming an opening which opens up onto said outer wall of said collar, said inner portion having two lateral side channels disposed to either side of said opening, said contact member having a raised central section and two lateral side sections on either side of said raised central section, said raised section being disposed in said outer portion of said recess means, said two lateral side sections being disposed in said two side channels of said recess means.

2. An electrical multi-pole plug-in according to claim 1 further comprising retaining means on said lateral side sections of said contact member engageable with said side channels to facilitate retaining said contact member in said recess means.

3. An electrical multi-pole plug-in according to claim 2 wherein said lateral side sections of said contact member have lateral edge surfaces, said retaining means comprising projections projecting from said lateral edge surfaces.

4. An electrical multi-pole plug-in according to claim 1 wherein said contact member has a generally U-shaped cross sectional configuration having a base part and two legs extending from said base part, said lateral side sections extending from said two legs with said two lateral side sections being generally parallel to said base part.

5. An electrical multi-pole plug-in according to claim 1 wherein said contact member has a contact surface substantially coplanar with said outer wall of said collar.

6. An electrical multi-pole plug-in according to claim 1 wherein said contact pin elements have extending pin sections extending generally perpendicular to said extending pin portions, said contact members having a first part and a second part, said first part being disposed in said recess means in said body means, said second part extending from said body means generally parallel to said extending pin sections, said second part of said contact members and said extending pin sections being adapted to be received in openings of a circuit board.

7. An electrical multi-pole plug-in according to claim 1 wherein said collar has two parallel outer collar walls, said recess means being disposed in each of said two parallel outer collar walls.

8. An electrical multi-pole plug-in according to claim 1 wherein said outer wall of said collar is a generally planar outer collar wall, said recess means being disposed in said outer collar wall, said recess means being designated first recess means, said body means having a generally planar indented wall which is parallel to and spaced from said outer collar wall, and second recess means in said indented wall, said contact members being disposed in said second recess means.

9. An electrical multi-pole plug-in according to claim 8 wherein said contact members comprise a first section disposed in said first recess means, a second section disposed in said second recess means and a third section joined to said first and second sections, said first and second sections being generally parallel to each other, said third section being generally perpendicular to said first and second sections.

10. An electrical multi-pole plug-in connector adapted to receive a mating plug having engageable parts, comprising body means of insulating material, a plurality of contact pin elements disposed on said body means, said body means having a bottom part, said plurality of contact pin elements having extending pin portions extending from said bottom part, said body means having a collar surrounding a plug-in space, said extending pin portions extending into said plug-in space, said collar having an outer wall, a pocket recess means in said outer wall of said collar, and contact members disposed in said pocket recess means, said extending pin portions and said contact members being engageable with said engageable parts of said mating plug when said mating plug is plugged into said connector in a position disposed in said plug-in space and a position juxtaposed to said outer wall of said collar, said pocket recess means having an outer portion opening up into an inner portion, said outer portion having a first transverse width, said inner wider portion having a second transverse width, said first transverse width being less than said second transverse width, said contact member having a first section disposed in said inner portion and a second section disposed in said outer portion.

11. An electrical multi-pole plug-in according to claim 10 further comprising retaining means on said lateral side sections of said contact member engageable with said side channels to facilitate retaining said contact member in said recess means.

12. An electrical multi-pole plug-in according to claim 11 wherein said lateral side sections of said contact member have lateral edge surfaces, said retaining means comprising projections projecting from said lateral edge surfaces.

13. An electrical multi-pole plug-in connector adapted to receive a mating plug having engageable parts, comprising a body means of insulating material, a plurality of contact pin elements disposed on said body means, said body means having a bottom part, said plurality of contact pin elements having extending pin portions extending from said bottom part, said body means having a collar extending from said bottom part, said collar defining a plug-in space with said collar surrounding said plug-in space, said extending pin portions extending into said plug-in space, said collar having an outer wall, recess means in said outer wall of said collar, and contact members disposed in said recess means, said extending pin portions and said contact members being engageable with said engageable parts of said mating plug, said recess means comprising a bottom, an inner recess portion juxtaposed to said bottom, and an outer recess portion juxtaposed to said inner recess portion, said inner recess portion having a first width, said outer recess portion having a second width less than said first width, said contact member having inner contact sections disposed in said inner recess portion, said contact member having an outer contact section disposed in said outer recess portion, said inner contact section having a third width, said outer contact section having a fourth width less than said third width.

14. An electrical multi-pole plug-in according to claim 13 wherein said first and third widths are substantially equal to each other.

15. An electrical multi-pole plug-in according to claim 14 wherein said second and fourth widths are substantially equal to each other.

* * * * *